US006093031A

United States Patent [19]

Longueville

[11] Patent Number: 6,093,031

[45] Date of Patent: Jul. 25, 2000

[54] ELECTRICAL CONNECTOR HAVING DIFFERENT INTERFACE MATRICES

[75] Inventor: Jacques Longueville, Oostkamp, Belgium

[73] Assignee: Siemens Aktiengesellschaft, Munich, Germany

[21] Appl. No.: 09/164,120

[22] Filed: Sep. 30, 1998

[30] Foreign Application Priority Data

Sep. 30, 1997 [DE] Germany ..... 197 43 364

[51] Int. Cl.[7] ..... H01R 12/00

[52] U.S. Cl. ..... 439/78; 439/79

[58] Field of Search ..... 439/78, 79, 83, 439/686

[56] References Cited

U.S. PATENT DOCUMENTS

| | | | |
|---|---|---|---|
| 3,573,718 | 4/1971 | Lightner | 439/637 |
| 4,732,565 | 3/1988 | Ito et al. | 439/79 |
| 4,808,115 | 2/1989 | Norton et al. | 439/79 |
| 5,090,116 | 2/1992 | Henschen et al. | 29/827 |
| 5,630,720 | 5/1997 | Kocher | 439/78 |
| 5,639,249 | 6/1997 | Lenoir | 439/79 |
| 5,816,830 | 10/1998 | Griffith et al. | 439/79 |
| 5,924,876 | 7/1999 | Beamenderfer et al. | 439/79 |

FOREIGN PATENT DOCUMENTS 0 365 179 A1 4/1990 European Pat. Off. ..... H01R 13/658

OTHER PUBLICATIONS

International Patent Application WO 92/09119 (Lemke et al.), dated May 29, 1992.

International Patent Application WO 96/05632 (Weidler et al.), dated Feb. 22, 1996.

*Primary Examiner*—Renee Luebke

*Assistant Examiner*—Michael C. Zarroli

*Attorney, Agent, or Firm*—Herbert L. Lerner; Laurence A. Greenberg; Werner H. Stemer

[57] ABSTRACT

An electrical connector for mounting on a printed circuit board and receiving a mating connector, the electrical connector includes multiple contacts having at one end a connection pin to engage conductors on the printed circuit board and at the other end contact elements to connect with terminals in the complementary connector, where the multiple contact elements define a contact element matrix being different than the connection pin matrix in occupied area, arrangement of rows, columns, and density.

10 Claims, 3 Drawing Sheets

ELECTRICAL CONNECTOR HAVING DIFFERENT INTERFACE MATRICES

BACKGROUND OF THE INVENTION

FIELD OF THE INVENTION

The present invention relates to an electrical connector for mounting on a printed circuit board, including contact elements merging into connection pins to be press-fitted into assigned press-fit holes in the printed circuit board.

Such electrical connectors are known in a multiplicity of embodiments and require no further description. On one hand, they are distinguished by the fact that they can be connected simply by press-fitting the connection pins thereof into the assigned press-fit holes on the printed circuit board. In other words, they can be electrically and mechanically connected to the printed circuit board in a rapid and simple manner. On the other hand, such electrical connectors cannot be constructed as small as is possible in the case of connectors which can be mounted differently on the printed circuit board. The size and the mutual distances between the press-fit holes on the printed circuit board are primarily responsible for the following difficulties. Production problems stand in the way of reducing the size of the press-fit holes (small holes cannot be electroplated very well with a large depth). Obstacles to reducing the mutual distances between the press-fit holes are a consequently reduced mechanical strength of the printed circuit board and a necessity of routing electrical conductor tracks in interspaces between the press-fit holes.

Miniaturization of circuit boards containing electrical connectors is limited. The reduction in physical strength caused by having too many holes through the board limits miniaturization. In addition, the necessity of routing electrical conductor tracks in interspaces between the press-fit holes also limits the minimum size of the circuit boards. In turn, the limited minimum size of circuit boards limits the minimum size of devices employing these circuit boars. The limit to miniaturization of the size of devices is considerable in light of industrial goals to reduce size while increasing performance.

SUMMARY OF THE INVENTION

It is accordingly an object of the invention to provide an electrical connector, which overcomes the hereinaforementioned disadvantages of the heretofore-known devices of this general type in such a way that it is not an obstacle standing in the way of further miniaturization.

With the foregoing and other objects in view there is provided, in accordance with the invention, an electrical connector for mounting on a printed circuit board, comprising connection pins for press-fitting into assigned press-fit holes in a printed circuit board, the connection pins having an arrangement and a mutual spacing; and contact elements merging into the connection pins, the contact elements having a different arrangement and/or a different mutual spacing than the connection pins.

As a result, the contact elements of the electrical connector and its connection pins provided for mounting on the printed circuit board (and therefore also the press-fit holes, which are in the printed circuit board and assigned to the connection pins) can be optimized independently of one another.

In the case of the press-fit holes, this opens up, inter alia, the possibility:

- that, on one hand, they can be arranged (distributed and/or grouped) relative to one another in such a way that the printed circuit board is optimized with regard to its form and/or size and/or with regard to other requirements, and
- that, on the other hand, they can be of such a large construction, and be spaced apart from one another to such an extent, that they can be produced without any difficulty and conductor tracks can be routed between them.

Independently of this, the contact elements can, for example, be constructed, arranged (rearranged) and/or pushed together in such a way that they enable the connection of miniaturized electrical connectors, whereby the space which is to be allocated on, above, below and/or next to the printed circuit board and/or within a device containing such a printed circuit board for the electrical connectors to be brought into contact, can be reduced to a minimum.

By virtue of the inventive construction of the electrical connector, the latter permits a considerable reduction in the size of the printed circuit boards provided with it and of the devices containing the same.

In accordance with another feature of the invention, the contact elements and the connection pins are parts of contact element-connection pin units having an elongate form and two ends, the contact element-connection pin units each having a contact element at one of the ends and a connection pin at the other of the ends.

In accordance with a further feature of the invention, the contact element-connection pin units each have a central part between the contact element and the connection pin, and the central part has a course with a direction change.

In accordance with an added feature of the invention, there is provided a housing with solidly constructed sections, the central parts of the contact element-connection pin units each running substantially completely within and/or along the solidly constructed sections.

In accordance with an additional feature of the invention, the contact elements are disposed in a contact element matrix having n rows and m columns, and the connection pins are disposed in a connection pin matrix having 2n rows and m/2 columns.

In accordance with yet another feature of the invention, there is provided an electrical connector base area, the connection pin matrix distributed substantially entirely over the base area.

In accordance with yet a further feature of the invention, the connection pin matrix occupies a given portion of the base area, and the contact element matrix occupies a fraction of the given portion.

In accordance with yet an added feature of the invention, the connection pins of a connection pin column are assigned to the contact elements of two contact element columns.

In accordance with a concomitant feature of the invention, as seen in a plan view, the connection pin column runs centrally between the contact element columns having the contact elements assigned to the connection pins.

Other features which are considered as characteristic for the invention are set forth in the appended claims.

Although the invention is illustrated and described herein as embodied in an electrical connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Referring now to the figures of the drawings in detail, there is seen an electrical connector which is described below and designated by reference symbol 1. The electrical connector is constructed to be mounted on a surface of a printed circuit board using press-fit technology. In the mounted state on the printed circuit board, the electrical connector serves to connect the printed circuit board to another printed circuit board plugged thereon. However, it may additionally or alternatively also be constructed for the connection of a cable or of other devices.

The electrical connector 1 is a plug connector in the example considered. However, the invention can also be applied in other types of electrical connectors, for example in the case of pressure connectors for making contact with surface contacts, etc. The electrical connector can also be constructed, inter alia, as a zero insertion force connector or a floating connector or it can have other particular constructions.

Figure 1:
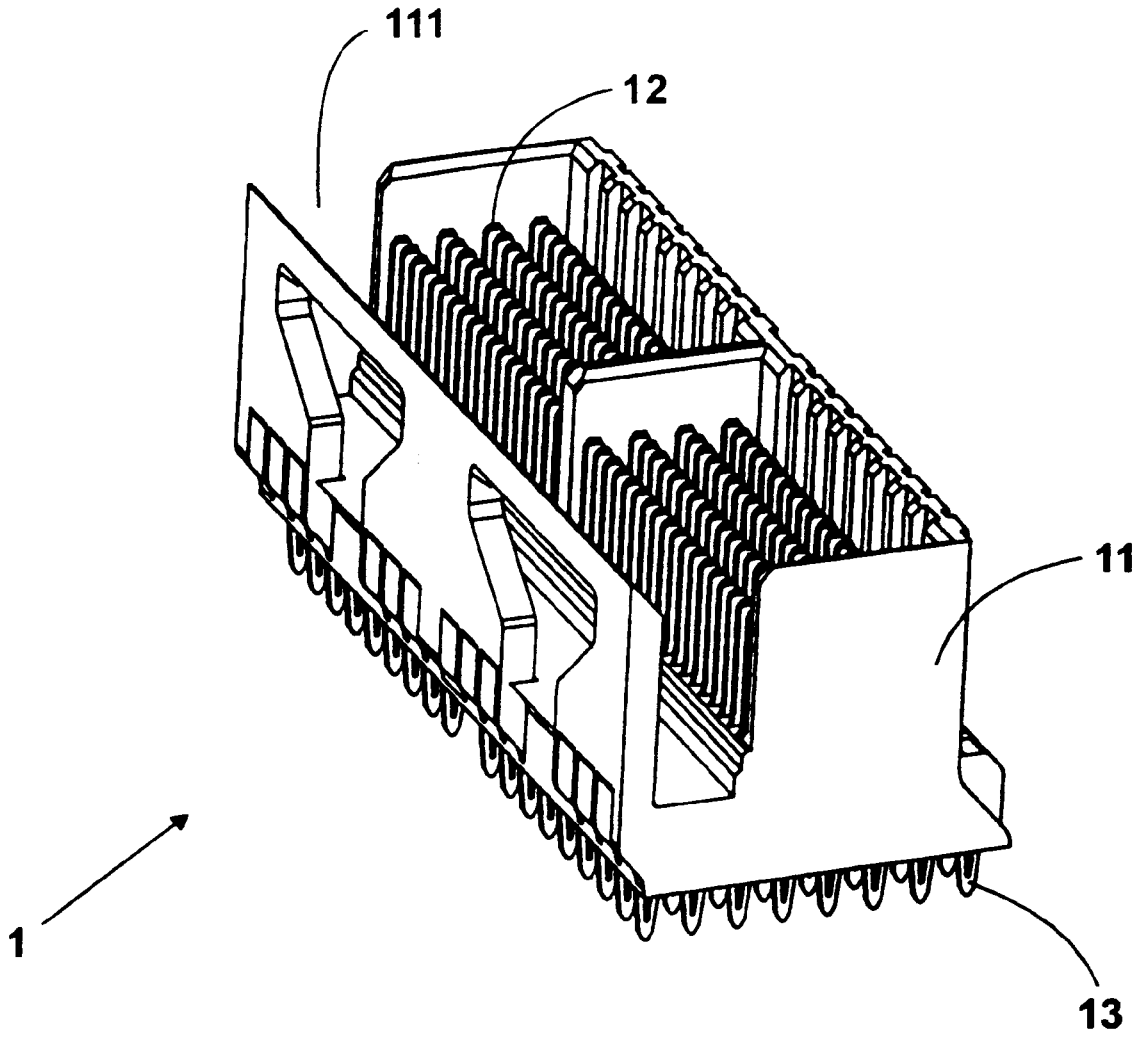
FIG. 1 is a diagrammatic, perspective view of an exemplary embodiment of a novel electrical connector according to the invention.
Figure 3:
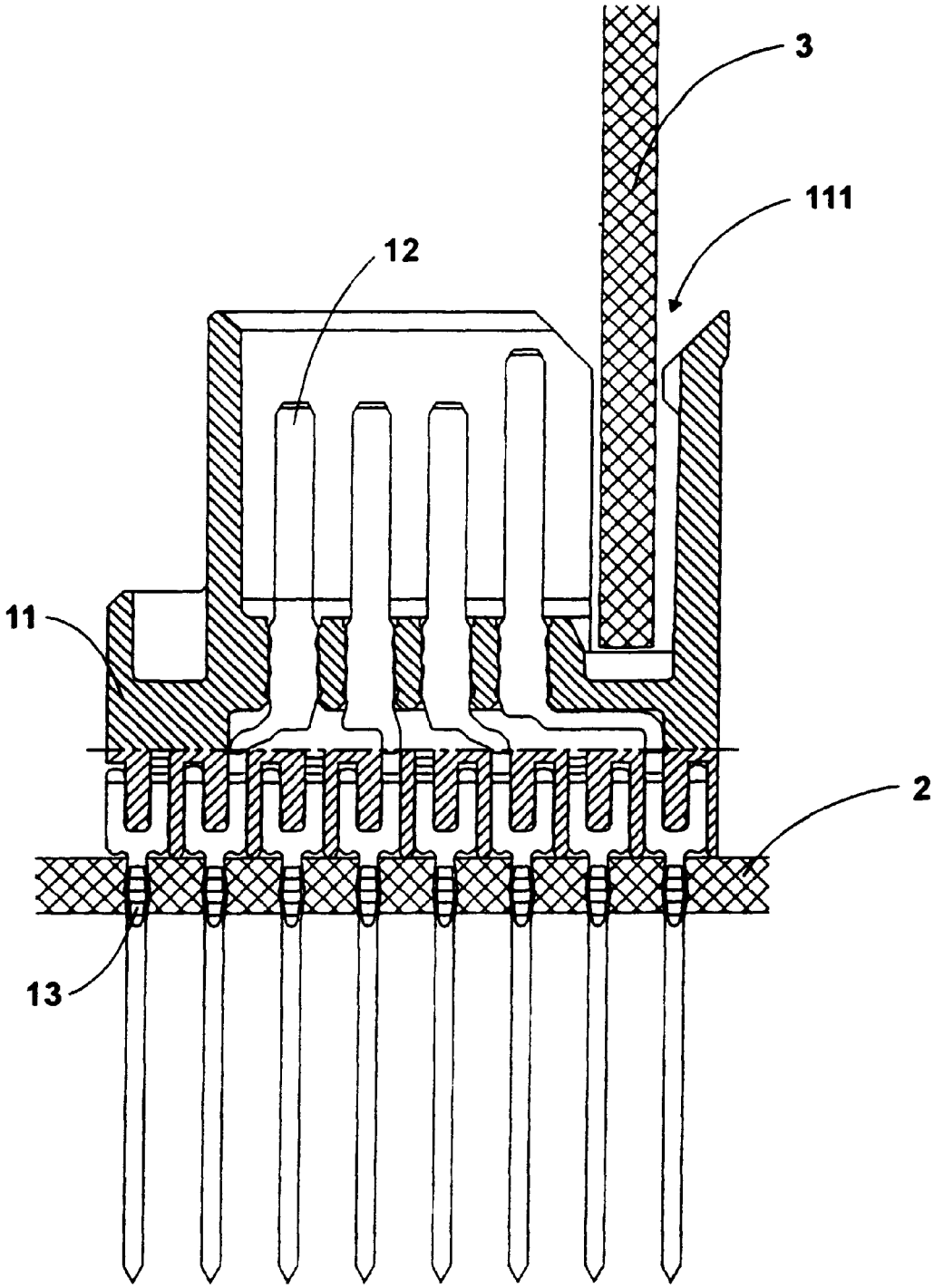
FIG. 3 is an enlarged, fragmentary, cross-sectional view of the electrical connector according to FIG. 1.

As is evident in particular from FIGS. 1 and 3, the electrical connector 1 includes a housing 11, a multiplicity of contact elements 12 and a multiplicity of (printed circuit board) connection pins 13.

Figure 2:
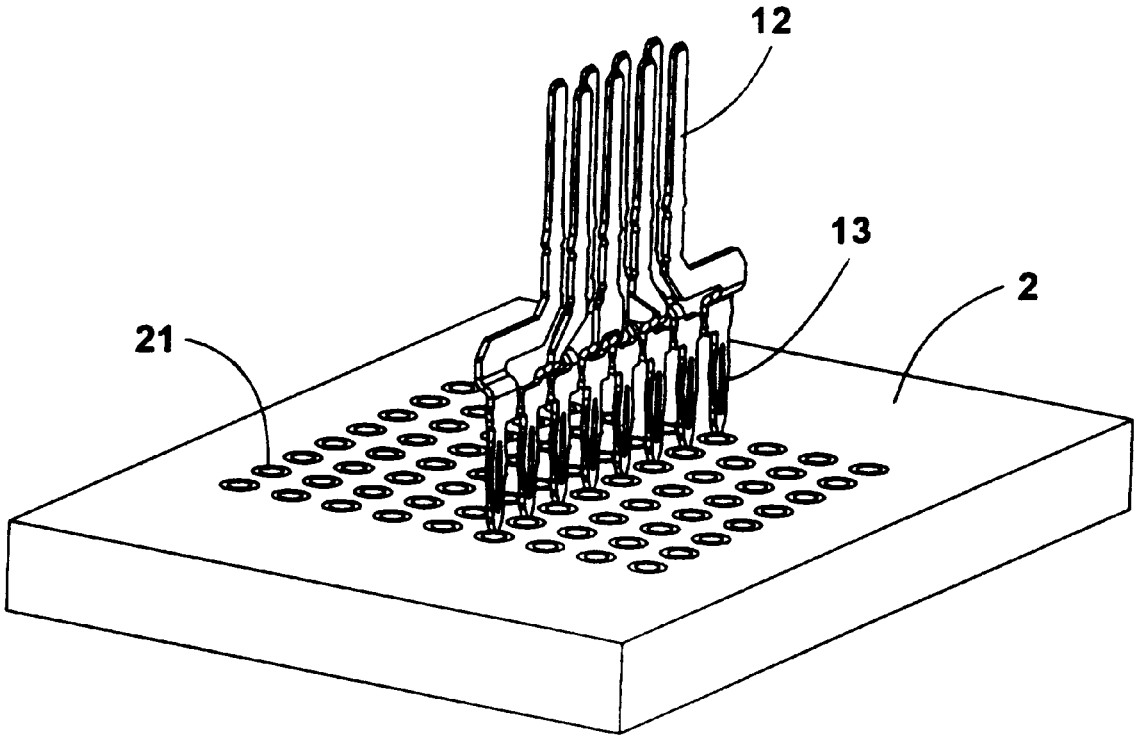
FIG. 2 is a perspective view of contact element-connection pin units of the electrical connector according to FIG. 1 and of a printed circuit board constructed for the mounting of the electrical connector.

FIG. 2 shows that the connection pins 13 are constructed to be press-fitted into assigned press-fit holes 21 in a printed circuit board 2. The connection pins 13 and/or the press-fit holes 21 are matched to one another in such a way that they are clamped together upon being pressed one into the other and thereby attain a fixed mechanical and electrical (the press-fit holes are coated with electrically conductive material) connection to the printed circuit board 2.

The contact elements 12 serve to establish electrical contact with contact elements of another electrical connector which is connected to the electrical connector 1. In the example considered, this other non-illustrated electrical connector is mounted on another printed circuit board 3, having an edge section, as shown in FIG. 3, that can be inserted into a recess 111 formed in the housing 11 of the electrical connector 1.

Each contact element 12 is assigned a connection pin 13. The mutually assigned contact elements 12 and connection pins 13 are formed in each case as a coherent unit within which the respective contact element and the assigned connection pin merge with one another. These contact element-connection pin units are, for example, elongate elements which are formed by sheet-metal stampings and, as is evident in particular from FIGS. 2 and 3, are constructed as a contact element on one of their ends and as a connection pin on their other end.

However, at the same time the contact elements 12 are disposed differently and spaced apart from one another differently than the connection pins 13. Whereas the contact elements are disposed in a matrix having n rows and m columns and occupy only part of a connector base area, the connection pins are disposed in a matrix having 2n rows and m/2 columns and are distributed over the entire connector base area.

Although the above-mentioned reconfiguration, which will be described in more detail below, constitutes a variant which is particularly advantageous above all with regard to the production of the electrical connector, there furthermore exists a large multiplicity of likewise advantageous, further reconfiguration possibilities.

The contact element-connection pin units at least partly have a (bent, curved and/or kinked) course which exhibits a direction change, differently than heretofore.

A construction of the contact element-connection pin units which is suitable for attaining the above-mentioned reconfiguration is illustrated in FIG. 2.

FIG. 2 shows a section of the printed circuit board 2 which includes the press-fit holes 21, and eight contact element-connection pin units of the electrical connector 1. The eight contact elements 12 represent two adjacent columns (m=2) of a contact element matrix which includes n rows (n=4) and m columns. The eight connection pins 13 represent one column of the connection pin matrix which includes 2n rows and m/2 columns. In this case:

- the outer left connection pin 13 in the connection pin column in accordance with the illustration in FIG. 2 is assigned to the outer left contact element 12 in the rear contact element column in accordance with the illustration in FIG. 2,
- the connection pin 13 which lies at the second location from the left in the connection pin column in accordance with the illustration in FIG. 2 is assigned to the outer left contact element 12 in the front contact element column in accordance with the illustration in FIG. 2,
- the connection pin 13 which lies at the third location from the left in the connection pin column in accordance with the illustration in FIG. 2 is assigned to the contact element 12 which lies at the second location from the left in the rear contact element column in accordance with the illustration in FIG. 2,
- the connection pin 13 which lies at the fourth location from the left in the connection pin column in accordance with the illustration in FIG. 2 is assigned to the contact element 12 which lies at the second location from the left in the front contact element column in accordance with the illustration in FIG. 2,
- the connection pin 13 which lies at the fifth location from the left in the connection pin column in accordance with the illustration in FIG. 2 is assigned to the contact element 12 which lies at the third location from the left in the rear contact element column in accordance with the illustration in FIG. 2,
- the connection pin 13 which lies at the sixth location from the left in the connection pin column in accordance with the illustration in FIG. 2 is assigned to the contact element 12 which lies at the third location from the left in the front contact element column in accordance with the illustration in FIG. 2,
- the connection pin 13 which lies at the seventh location from the left in the connection pin column in accordance with the illustration in FIG. 2 is assigned to the outer right contact element 12 in the rear contact element column in accordance with the illustration in FIG. 2, and the outer right connection pin 13 in the connection pin column in accordance with the illustration in FIG. 2 is assigned to the outer right contact element 12 in the front contact element column in accordance with the illustration in FIG. 2.

A plan view would show that the connection pin column assigned to the two contact element columns runs centrally between the contact element columns.

In the example considered, the contact element-connection pin units have the local course shown in FIG. 2. In other words, in contrast to the contact element-connection pin units of conventional electrical connectors of the type described, they do not have an essentially rectilinear course but rather change directions a number of times in their central part between the contact element and the connection pin.

The bent, curved and/or kinked central parts of the contact element-connection pin units preferably run essentially completely within and/or along solidly constructed sections of the housing 11 of the electrical connector. They are at least partly embedded in the relevant housing section (encapsulated by the latter) and form an inseparable unit with the housing section. Only the essentially straight parts of the contact element-connection pin units, that is to say in particular the contact elements 12 and the connection pins 13, project freely upward and downward. This minimizes the risk that the bent, curved and/or kinked central parts of the contact element-connection pin units will not withstand the press-fitting pressure to be applied to the printed circuit board during the mounting of the electrical connector and will be damaged (deformed) by the pressure.

The contact elements and the connection pins can be given different arrangements and/or mutual distances by virtue of the particular construction of the contact element-connection pin units.

In the present case, this configuration freedom has been utilized to the effect that the contact elements 12 are disposed in half as many rows, but twice as many columns, as the connection pins 13. Neighboring contact element rows are separated by the same distance as neighboring connection pin rows, but neighboring contact element columns are separated only by half the distance that neighboring connection pin columns have between one another.

If the contact elements are disposed in a uniform grid pattern, so that neighboring contact elements of a column are removed from one another to exactly the same extent as neighboring contact element columns (for example 2.5 mm in each case), then the connection pin columns can be relatively far removed from one another. Conductor tracks can be routed in this relatively wide interspace between neighboring connection pin columns, and more precisely in interspaces between the assigned press-fit holes in the printed circuit board.

In the example considered, the contact element columns and the connection pin columns, which are considerably longer (twice as long) as compared with the contact element columns, are disposed in such a way that they are centered relative to one another with regard to their length. However, they may also have any other relative positions.

Independently of the relative position of the contact element matrix and of the connection pin matrix, the contact elements 13 are distributed only over part of the base area of the electrical connector. That part of the base area of the electrical connector which is not occupied by the contact elements 13 can be utilized in another way. In the example considered, the electrical connector is constructed for the insertion of the printed circuit board, with which contact is to be established through the electrical connector.

The dense configuration of the contact elements 12 furthermore makes it possible to construct the electrical connector which is to be brought into contact with the electrical connector in such a way that it is small. Therefore, the electrical connectors to be brought into contact take up little space in total and can even be brought into contact with one another in a confined space.

As a result, the space which is to be allocated on, above, below and/or next to the printed circuit board and/or within a device containing such a printed circuit board for the electrical connectors to be brought into contact, can be reduced to a minimum.

I claim:

1. An electrical connector for mounting on a printed circuit board formed with press-fit holes, comprising:

connection pins being disposed in the press-fit holes in the printed circuit board, said connection pins having an arrangement and a mutual spacing, and said connection pins forming a connection pin matrix, said connection pin matrix having 2n rows and m/2 columns, with n and m each being integers; and contact elements merging into said connection pins, said contact elements having a different mutual spacing than said connection pins, and said contact elements forming a contact element matrix, said contact element matrix having n rows and m columns.

2. The electrical connector according to claim 1, wherein said contact elements and said connection pins are parts of contact element-connection pin units having an elongate form and two ends, said contact element-connection pin units each having a contact element at one of said ends and a connection pin at the other of said ends.

3. The electrical connector according to claim 2, wherein said contact element-connection pin units each have a central part between said contact element and said connection pin, and said central part has a course with a direction change.

4. The electrical connector according to claim 3, including a housing with solidly constructed sections, said central parts of said contact element-connection pin units each running substantially completely within said solidly constructed sections.

5. The electrical connector according to claim 3, including a housing with solidly constructed sections, said central parts of said contact element-connection pin units each running substantially completely within and along said solidly constructed sections.

6. The electrical connector according to claim 3, including a housing with solidly constructed sections, said central parts of said contact element-connection pin units each running substantially completely along said solidly constructed sections.

7. The electrical connector according to claim 1, including a base area, said connection pin matrix distributed substantially entirely over said base area.

8. The electrical connector according to claim 1, including a base area, said connection pin matrix occupying a given portion of said base area, and said contact element matrix occupying a fraction of said given portion.

9. The electrical connector according to claim 1, wherein said connection pins of a connection pin column are assigned to said contact elements of two contact element columns.

10. The electrical connector according to claim 9, wherein, as seen in a plan view, said connection pin column runs centrally between said contact element columns having said contact elements assigned to said connection pins.

* * * * *